United States Patent [19]

Subramanian et al.

[11] 4,280,988

[45] Jul. 28, 1981

[54] RECOVERY OF NICKEL AND COBALT FROM LEACH SLURRIES

[75] Inventors: Kohur N. Subramanian, East Hanover, N.J.; Gerald V. Glaum, Oakville; Einar Walli, Burlington, both of Calif.X

[73] Assignee: The International Nickel Co., Inc., New York, N.Y.

[21] Appl. No.: 137,402

[22] Filed: Apr. 4, 1980

[51] Int. Cl.[3] ..... C01G 51/00; C01G 53/11

[52] U.S. Cl. ..... 423/140; 209/167; 75/2

[58] Field of Search ..... 423/140; 209/167

[56] References Cited

U.S. PATENT DOCUMENTS 2,195,724 4/1940 Gaudin ..... 209/167

OTHER PUBLICATIONS

Kirk—Othmer, *Encyclopedia of Chemical Technology*, 2nd Edition, Interscience, N.Y. 1966, vol. 9, pp. 380–393.

*Primary Examiner*—Brian E. Hearn

*Attorney, Agent, or Firm*—R. J. Kenny; F. J. Mulligan

[57] ABSTRACT

A slurry, such as might be obtained from acid leaching nickeliferous ores having a high iron content, is treated to separate dissolved nickel or cobalt from iron oxide solids. The treatment involves a controlled precipitation of the non-ferrous metal with the aid of calcium sulfide or barium sulfide followed by flotation to recover a high grade concentrate of the non-ferrous metal.

9 Claims, 3 Drawing Figures

RECOVERY OF NICKEL AND COBALT FROM LEACH SLURRIES

FIELD OF THE INVENTION

The present invention relates to a process for recovering nickel and/or cobalt from slurries which contain dissolved nickel and/or cobalt values together with hydrated iron oxide solids.

BACKGROUND OF THE INVENTION

Substantial reserves are known to exist of ores, both of the oxidic and sulfidic types, which contain relatively small amounts of nickel and/or cobalt with relatively large amounts of iron. Hydrometallurgical processes for recovering the nickel or cobalt from such ores often entail an acidic leach as the first step, the end product of which is a slurry comprised of a liquor containing small amounts of dissolved nickel and/or cobalt and substantial amounts of hydrated iron oxide solids.

Typically treatment of slurries of this type entails an initial solid/liquid separation step, with settling and decantation or filtration, to obtain a clarified liquor from which the nickel or cobalt can be recovered. The solid/liquid separation step is made awkward by the fact that the iron containing solids tend to be in finely divided form. As a result, the separation contributes significantly to the costs of a commercial operation.

OBJECT OF THE INVENTION

It is an object of the invention to provide a process for recovering the dissolved nickel and/or cobalt from such slurries without resorting to the difficult task of first separating the iron oxide solids from the liquor.

SUMMARY OF THE INVENTION

The invention is based on the discovery that by using suitable reagents and conditions, the slurry as a whole can be treated so as to precipitate the nickel and/or cobalt as sulfide(s) which can readily be separated from the iron oxide by means of flotation.

Accordingly, the present invention provides a process for separating at least one non-ferrous metal selected from the group consisting of nickel and cobalt from a slurry which contains dissolved non-ferrous metal(s) and iron oxide solids, comprising adjusting the acidity of the slurry, if necessary, to ensure that the pH thereof does not exceed about 4; contacting the slurry with a sulfiding agent selected from the group consisting of calcium sulfide and barium sulfide, at a temperature of about 60°-80° C., in a plurality of series-connected reactors, the residence time in the first reactor of the series being shorter than about 15 minutes; controlling the overall residence time as well as the amount of sulfiding agent used to ensure precipitation of a large proportion of the non-ferrous metal as a sulfide; and thereafter subjecting the resulting slurry to flotation to recover a high grade concentrate containing a large proportion of the non-ferrous metal and a tailings slurry containing substantially all of the iron oxide solids.

In the course of the description which follows reference will be made to separation of nickel from an iron-containing slurry. It should be understood that the behavior of cobalt will be similar to that of nickel so that any emphasis of nickel is only intended to avoid unnecessary repetition.

The technique of sulfidation is well known as a means for precipitating metals such as nickel from solutions hereof. In general it is carried out by treating the nickel-containing solution with hydrogen sulfide. However, this standard procedure for sulfidation offers no solution to the problem of nickel separation from a slurry in which substantial amounts of iron oxide solids are present. This is because such a sulfidation is not selective to nickel and results in reaction of the hydrogen sulfide with the iron oxide. Two undesirable consequences flow from this, namely, the use of large quantities of the sulfiding agent and the formation of sulfides of iron mixed with the nickel sulfide making separation of the latter more difficult. Thus if a leach slurry containing dissolved nickel and iron oxide solids is treated with hydrogen sulfide and then subjected to flotation, the concentrate obtained would be one of relatively poor nickel grade.

A commercially viable separation process in accordance with the invention should possess the following features: good utilization of the sulfiding agent, an acceptably high recovery of nickel in the concentrate produced, and a high nickel grade in the latter. This combination of features can be achieved only if the sulfidation step is carried out using the reagents and controlled procedure of the present invention. When this is done, the sulfiding agents of the invention have been found to react preferentially with the nickel, thus avoiding undesirable reaction with the iron.

The reacting slurry should be maintained at about 60°-80° C. during the precipitation. Higher temperatures are unnecessarily expensive to resort to inasmuch as no further benefit is achieved thereby. On the other hand, too low a precipitation temperature has been found detrimental to achieving the desired high recovery of nickel in the flotation concentrate produced after the precipitation.

The prevailing pH conditions during the precipitation are an essential criterion to success of the process. In order to achieve both the selectivity of sulfidation and good floatability of the precipitated nickel, the latter should be precipitated at a pH value no higher than about 4.0 to 4.5. Because of a tendency for the pH to rise somewhat during the precipitation, it is necessary to ensure that the initial pH of the slurry does not exceed about 4. Preferably the initial pH should be 3 or less. On the other hand, conditions which are too acidic are also to be avoided because of the tendency for acid to react with the calcium sulfide or barium sulfide to generate hydrogen sulfide. The generation of hydrogen sulfide is not only environmentally objectionable but also detracts from the good utilization of the calcium sulfide or barium sulfide. Accordingly where, as in the case of a feed slurry obtained directly from an acid leaching process, the pH is very low, e.g., 1 or less, we prefer to raise the pH to at least about 2 not more than 3. This is conveniently and economically performed with the aid of lime or limestone.

The precipitation of the nickel sulfide has to be carried out in a multistage fashion by using at least two precipitation vessels. The term "vessel" is used herein in a very broad sense to denote any apparatus within which the nickel-containing slurry is contacted with the sulfiding agent at the appropriate precipitation temperature. Thus the hot nickel containing slurry and an aqueous slurry of the sulfiding agent may be separately fed to a small tank and thereafter into a larger tank. The flow rate should be such that the residence time in the first tank is less than 15 minutes, preferably only of the order of 3 minutes or less. However, according to a preferred embodiment of the invention, the first stage of the precipitation is made to occur in a conduit rather than a tank. This is accomplished by feeding the hot nickel containing slurry and the sulfiding agent to respective arms of a "T" shaped junction, the third arm of which discharges the partially reacted mixture into a tank. In such a set-up the "T" junction constitutes a first vessel wherein some of the nickel precipitation occurs and a very short residence time in this first vessel, e.g., of the order of a few seconds, has been found to give satisfactory results.

While the precipitation can be carried out in a batch by batch manner, it is preferred to adopt a continuous procedure which is more amenable to control so as to achieve the desired end point for the reaction as will now be described.

The amount of sulfiding agent used has to be selected in accordance with the extent of precipitation which is aimed at. We have found that if attempts are made at achieving a substantially complete sulfidation of all the nickel, both the reagent utilization and final nickel grade of the product separated are adversely affected. We have found that a preferred end point to aim at is less than complete precipitation which leaves at least about 50 mg/l, and preferably 100 to 300 mg/l, of nickel dissolved in the final liquor. When such a procedure is adopted, the resulting slurry is found to have good flotation characteristics, yielding a concentrate of high nickel grade which contains a substantial part of the nickel in the feed.

After separating a high grade concentrate from the slurry, the balance of the nickel which was present in the feed slurry is present in the liquor or solids of the tailings of the flotation performed. To recover the majority of this remainder of the nickel a further sulfidation is carried out on the tailings slurry. For this sulfidation the same sulfiding reagents, temperature and pH conditions, are adhered to as in the initial sulfidation, except that the amount of sulfiding agent is chosen to ensure an essentially complete nickel precipitation. The re-sulfidized slurry is then subjected to flotation to recover a nickel concentrate which is of comparatively low grade and can be recycled by redissolving it in a fresh feed slurry to be treated. In this way we have found it possible to define a flow sheet which enables overall nickel recoveries of the order of 95–98% of the dissolved nickel present in the feed slurry, while the amount of nickel involved in the recycling represents, for example, 10 to 15% of the total dissolved nickel present in the feed.

The control of the end point by means of the amount of sulfiding agent used can be accomplished in any convenient manner. Redox potential measurement may be used for monitoring the progress of the reaction, however we have found such measurements are not sufficiently reliable, and it is preferable to monitor the nickel content of the liquor during the course of a continuous reaction and add the sulfiding agent accordingly.

The operation of concentrating the nickel sulfide produced by the precipitation involves the use of known flotation techniques. A multistage flotation is desirable and it is preferred to carry it out on the hot reacted slurry, i.e., at a temperature of up to 80° C. A collecting agent may be selected from the group of compounds including sulfhydryls, dithiophosphates, thionocarbamates and dithiocarbamates. Examples of suitable frothing agents include methyl isobutyl carbinol and polypropylene glycol methyl ether.

Some examples of the invention will now be described with reference to the accompanying drawings.

DETAILED DESCRIPTION OF THE EMBODIMENTS

Figure 1:
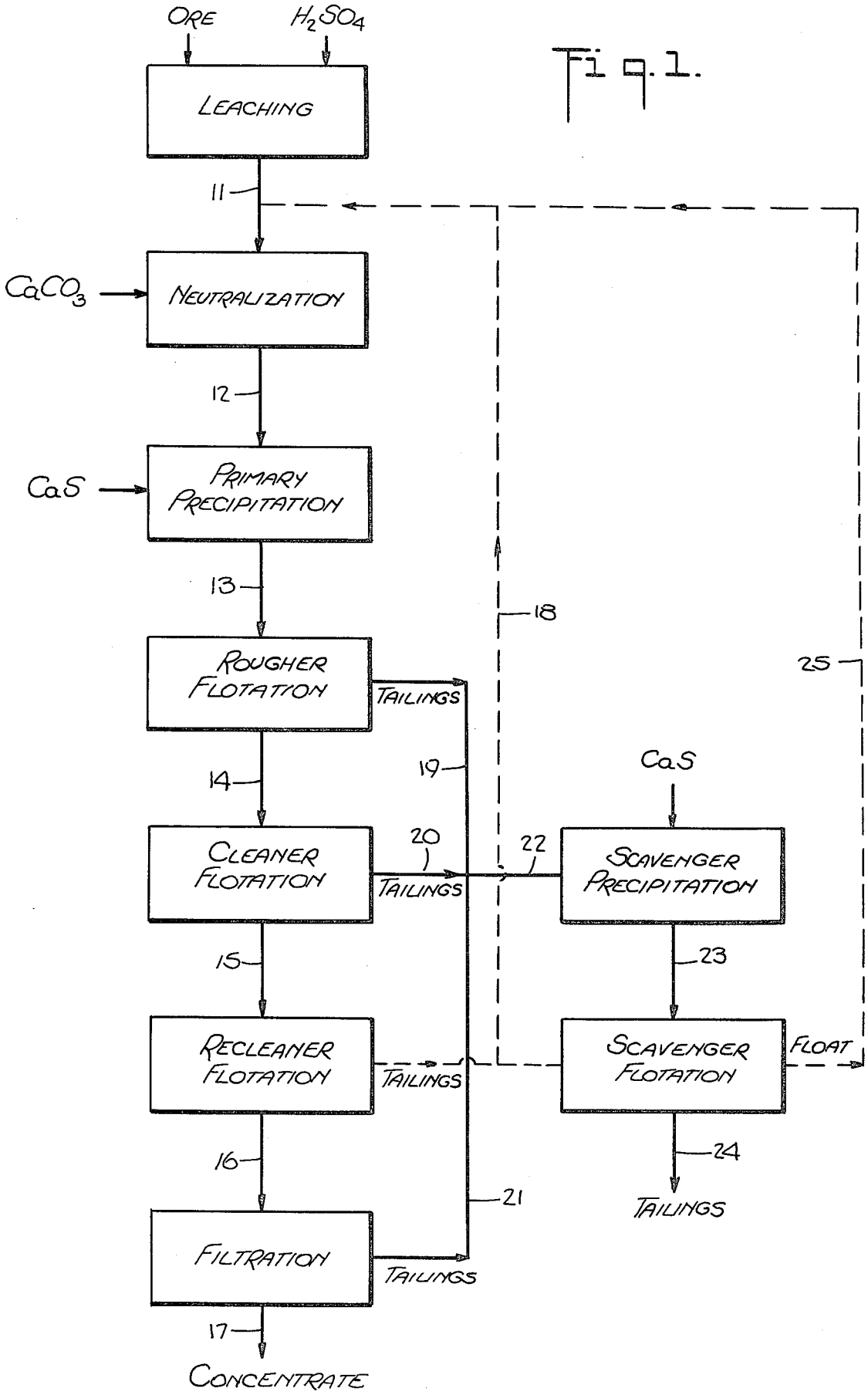
FIG. 1 depicts a flow diagram of an embodiment of the invention as applied to the treatment of a nickel and iron-containing ore.

Referring to FIG. 1, an ore which may be a limonitic ore containing nickel and cobalt and high amounts of iron is treated with sulfuric acid in a leaching operation which produces a slurry 11 comprising a nickel-containing liquor and oxidic iron solids. This slurry is fed to a neutralization operation where its pH is adjusted to a value of 2–3 by means of limestone addition. The neutralized slurry 12 is then subjected to primary precipitation, which in accordance with the invention is carried out at 60°–80° C., in two stages, using a short residence in the first stage and using an aqueous slurry of calcium sulfide as the precipitation agent. The latter is used in an amount insufficient to precipitate all of the nickel present in solution.

The resulting slurry 13 containing precipitated nickel sulfide as well as iron oxide solids is subjected to a three-stage flotation. The first stage, referred to as the rougher flotation, produces a float product 14 which is fed to the second stage, referred to as the cleaner flotation. The float product from the latter, 15 is fed to the final stage or recleaner flotation to produce a float product 16 which is subjected to filtration to separate the desired high grade nickel concentrate 17.

The tailings product 18 from the recleaner flotation is recycled back to redissolve precipitated nickel in fresh leach slurry 11 and fed to the neutralization step.

Tailings 19 and 20 from the rougher and cleaner flotation stages respectively are combined with the filtrate 21 obtained from the final filtration step and are fed as a slurry 22 to a scavenging operation entailing precipitation and flotation steps. The scavenging precipitation is carried out in the same manner as the primary precipitation except that the calcium sulfide addition is adjusted to ensure almost complete precipitation of any nickel in solution. The resulting slurry 23 is fed to the scavenger flotation operation, the tailings from which 24 will contain most of the iron in the original feed and very little of the nickel. The float product 25 obtained from the scavenger flotation is of inferior nickel grade to the concentrate 17, accordingly, this lower grade concentrate 25 is recycled to be combined with the stream 11 to redissolve precipitated nickel prior to feeding to the neutralization stage.

EXAMPLES

To determine the effect of such parameters as pH, temperature and sulfiding agent on the precipitation, a series of tests were carried out using a simplified version of the scheme depicted in FIG. 1. For the purpose of these tests no scavenging was performed. Moreover, no recleaner flotation was carried out so that the float product from the cleaner flotation was simply filtered and assayed.

All of the tests were carried out on a leach slurry derived from a leaching operation wherein a limonitic ore containing 1.5% Ni, 0.15% Co and 47% Fe (unless otherwise specified all percentages quoted are percentages by weight) was treated at 240°-255° C. with an amount of sulfuric acid corresponding to 20-25% of the ore weight and at an initial pulp density of between 26 and 31% solids. A typical assay of the leach slurry, after neutralization to a pH of about 2 to 2.5, showed that it was comprised of 27% solids which contained about 0.1% Ni and 50% Fe, and a liquor containing, in grams per liter (g/l): 5.3 Ni, 0.49 Co, 3.2 Mn, 1.0 Fe, 0.64 Mg, 2.2 Al, 0.1 Cr and 1 to 10 $H_2SO_4$. Thus the distribution of nickel in the leach slurry was about 93% in the solution and 7% in the solids.

A first set of experiments was carried out to determine the effect of pH on the separation process. The above mentioned leach slurry was treated with an aqueous slurry of a sulfiding agent prepared by pyrometallurgical reduction of calcium sulfate, the aqueous slurry having 10% by weight of solids which analyzed 74.7% CaS. The precipitation was carried out, with an overall residence of 15 minutes, at 75° C. and with the acidity being adjusted to give a final pH of 2, 3 and 4 in the respective tests. After the precipitation, the two stage flotation was carried out at 20° C., using potassium amyl xanthate as the collector and polypropylene glycol methyl ether as the frother. Table 1 shows the analysis of the concentrates obtained in the tests.

TABLE 1

| Test | Final pH | Concentrate Analysis (%) Ni | Fe | S | % Recovery of Ni in concentrate |
|---|---|---|---|---|---|
| A | 2 | 12.9 | 38 | 12.9 | 74 |
| B | 3 | 15.6 | 33 | 18.3 | 93 |
| C | 4 | 8.8 | 41 | 9.5 | 71 |

The results of the above tests indicated that a pH of 3 gave the best results in terms of both nickel recovered in the concentrate and the grade of the latter. For that preferred test (B) the analyses of the various streams were as follows. The cleaner tailings assayed 0.17% Ni and 56% Fe, representing 2.3% of the nickel in the feed. The rougher tailings assayed 0.09% Ni and 46% Fe, representing 4.4% of the nickel in the feed. The barren solution from the filtration step contained 0.01 g/l Ni and 7.3 g/l Fe, representing 0.2% of the feed nickel.

To investigate the effect of precipitation temperature a second set of experiments was carried out in a similar manner to the first. In this case the final pH was set at 3 and a total residence time of 20 minutes (10 minutes in each of two vessels) was used. Three tests D, E, and F were conducted wherein the precipitation was carried out at 75, 60 and 45° C. respectively. In each case the calcium sulfide addition was chosen to provide a redox potential of −300 mV (measured with respect to a standard calomel electrode). Table 2 below shows the results obtained. It will be seen that when a temperature of 45° C. (not in accordance with the invention) was used, the outcome was not only a poor recovery of nickel in the concentrate but also an undesirably high consumption of sulfiding agent.

TABLE 2

| Test | Precipitation Temp. (°C.) | Concentrate Analysis (%) Ni | Fe | S | % Recovery of Ni in Concentrate | *Wt. of CaS used |
|---|---|---|---|---|---|---|
| D | 75 | 14.7 | 23 | 18.4 | 89 | 4.7 |
| E | 60 | 18.3 | 23 | 19.9 | 91 | 4.1 |
| F | 45 | 13.5 | 22 | 21 | 64 | 8.7 |

*expressed as percentage of weight of limonitic ore

A comparison was made between the effectiveness of CaS and $H_2S$ as sulfiding agent by carrying out a pair of tests G and H in a similar manner to that described above except for the following details. The pH was controlled at about 3 and the sulfiding agent and residence times were adjusted to ensure a final redox potential −250 mV. It was found that:

(a) whereas a total residence time of 10 minutes (5 minutes in each stage) was required for the precipitation with calcium sulfide, a 30 minute total residence time was needed when hydrogen sulfide was used;

(b) a much poorer utilization of reagent was achieved with hydrogen sulfide, necessitating the use of more than twice as much of this reagent (in molar terms) compared with the amount of calcium sulfide needed to attain the same redox potential;

(c) despite the longer residence and greater amounts of sulfiding agent used, the concentrate recovered was of very much poorer grade in the case where hydrogen sulfide was used, the nickel to iron ratio in this concentrate being only 1:6, compared to 1:1.6 for the concentrate produced when calcium sulfide was used.

TABLE 3

| Test | Sulfiding Agent | Amount* of Sulfiding Agent | Concentrate Analysis (%) Ni | Fe | S | % Recovery of Ni in concentrate |
|---|---|---|---|---|---|---|
| G | CaS | 2.1 | 14.7 | 23 | 18.4 | 89 |
| H | $H_2S$ | 4.5 | 6.2 | 37 | 22 | 95 |

*expressed for comparison as weight of $S^{2-}$ as percentage of ore weight

Figure 2:
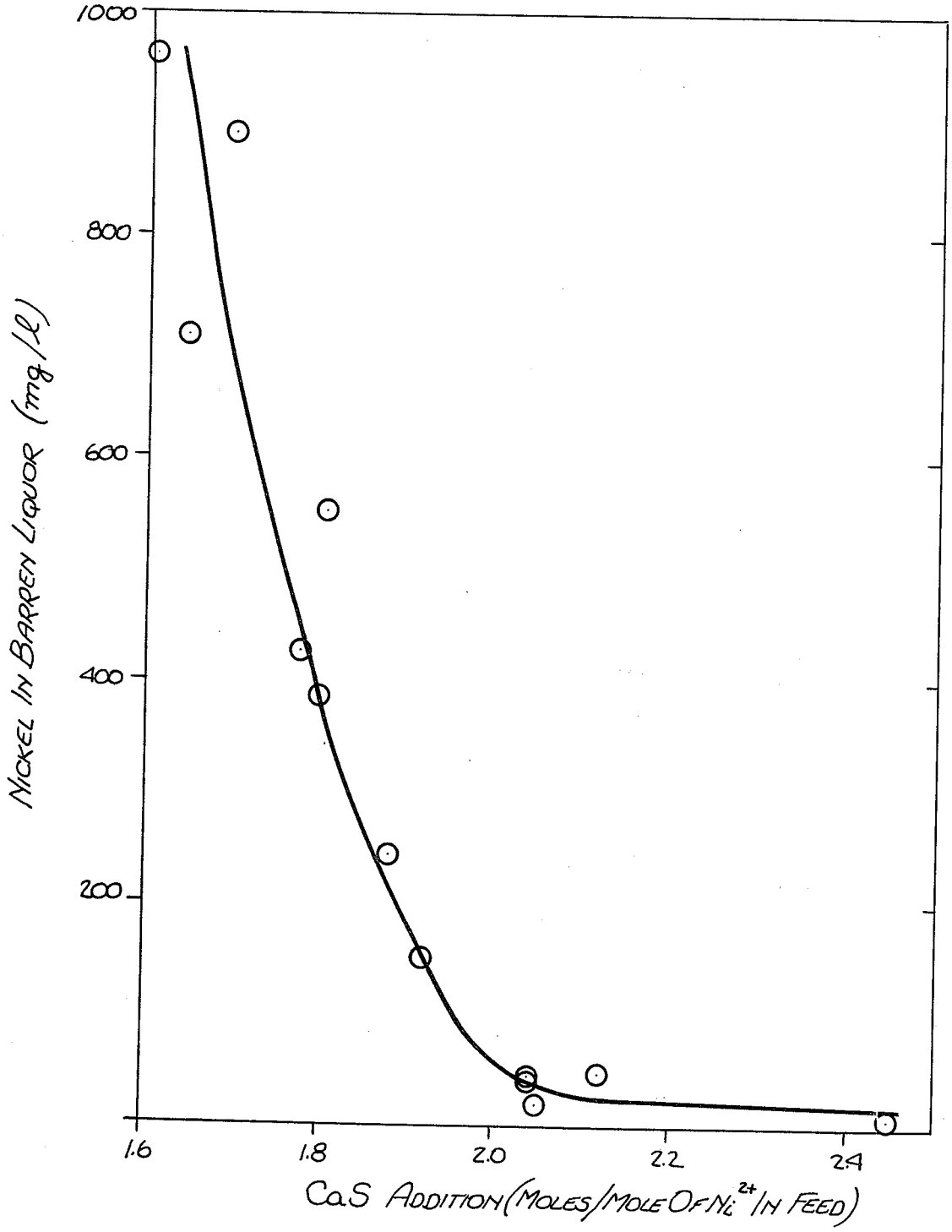
FIGS. 2 and 3 are graphs illustrating the effects of precipitating different proportions of the dissolved nickel.

A further set of experiments were conducted in which the effect of various amounts of sulfiding agent was investigated. For these tests the preferred apparatus consisting of a "T" shaped reactor followed by a conventional vessel was employed. The residence time in the "T" reactor was less than 3 seconds. The overall residence was found not to be critical and a five minute residence was used for each of the experiments in this series. The amount of calcium sulfide was chosen to achieve various levels of precipitation and in each case the concentrate obtained, after a three stage flotation as illustrated in FIG. 1, was analyzed. FIG. 2 shows a plot of the nickel content of the barren liquor, i.e., the amount of mg/l of nickel left in solution after the precipitation process, as a function of the amount of sulfiding agent used (expressed in moles of CaS per mole of $Ni^{2+}$ dissolved in the original slurry). The graph illustrates the inordinately high amounts of sulfiding agent which have to be used if attempts are made to achieve a total precipitation of the nickel. It is clear from this curve that the utilization of sulfiding agent begins to become poor as one seeks to reduce the nickel content of the barren liquor below 50 mg/l or so.

Figure 3:
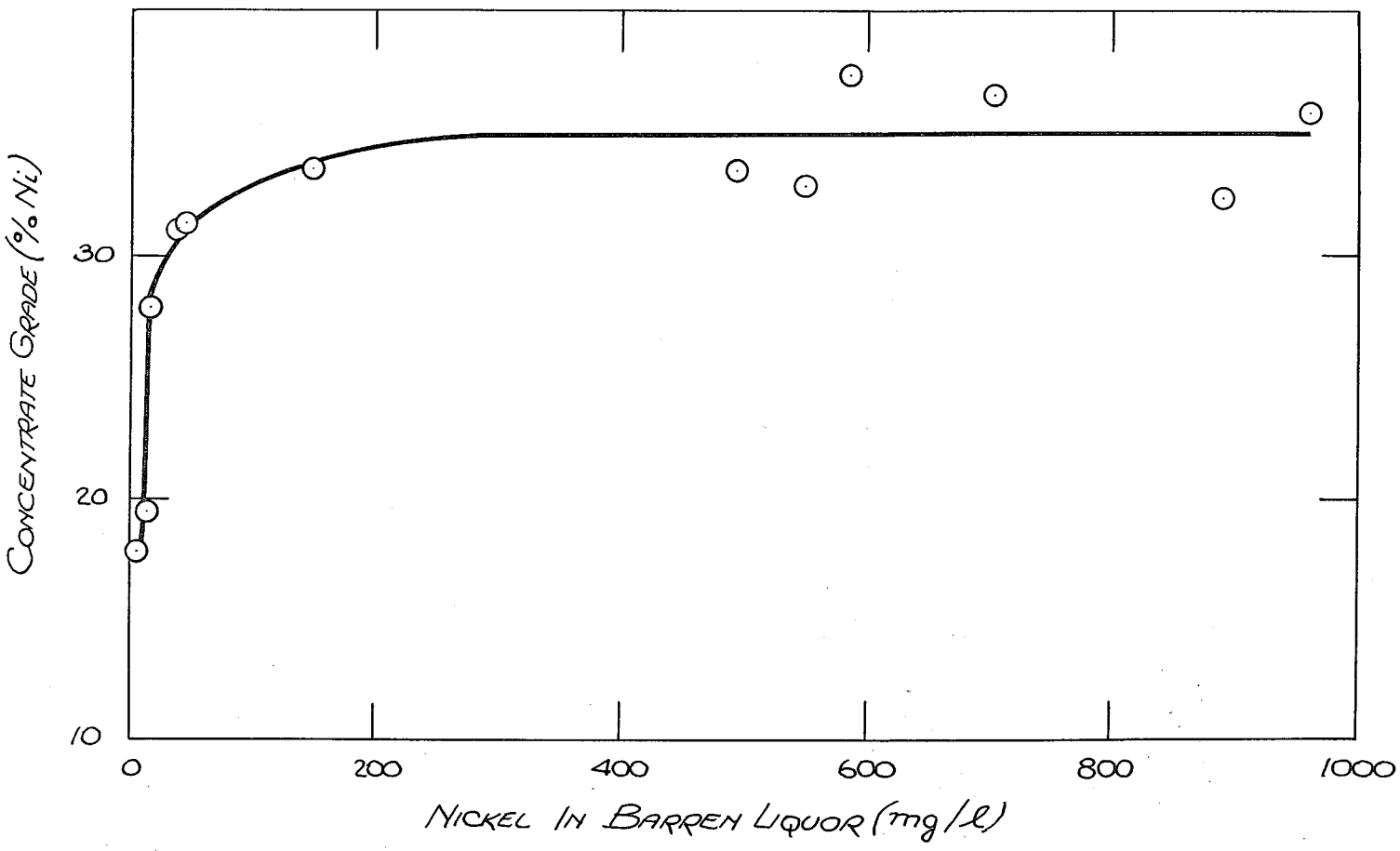

FIG. 3 shows the effect of attempting to lower the residual amount of dissolved nickel on the concentrate grade (% Ni in the concentrate). It is seen that the concentrate grade begins to suffer as the residual dissolved nickel falls below 200 mg/l or so and suffers very markedly when the nickel content of the barren liquor falls below about 50 mg/l. The nickel recovered in the concentrate is also optimum at a residual nickel level of about 200 mg/l. Above this level of nickel in the barren liquor the nickel recovery decreases slightly. However, at lower levels of residual nickel, most particularly below 50 mg/l, the nickel recovery also falls very sharply. The reasons for this decrease in flotation recovery are uncertain, but may involve decreased reactivity of the surface of the sulfide precipitate with the flotation collector.

The above results show that aiming at a residual level of dissolved nickel of 100–300 mg/l provides an optimum condition for achieving good reagent utilization, good nickel recovery and a high grade of concentrate. This information was put to use in designing the process depicted in FIG. 1. A test was carried out using this process on a leach slurry similar to that used for the previously described tests. The slurry was neutralized to pH 2 and the primary precipitation was carried out using a "T" reactor for the initial stage. The precipitation temperature was 80° C., with a 5 minute total residence time. The amount of calcium sulfide added corresponded to 1.37 moles per mole of ($Ni^{2+}+Co^{2+}$) present in the slurry. After the precipitation the flotation was carried out at 55° C. in three stages and the analyses of the various streams are shown in Table 4.

TABLE 4

| Stream | Weight or Volume of Stream | Ni Analysis of Stream | Distribution* of Ni in Stream |
|---|---|---|---|
| Leach slurry solids | 2284 g | 0.10% | 6.9 |
| Leach slurry solution | 4.31 l | 7.17 g/l | 93.1 |
| Rougher tailings solids | 2071.8 g | 0.08% | 5.00 |
| Rougher tailings solution | 6.27 l | 0.377 g/l | 7.13 |
| Cleaner tailings solids | 214.2 g | 0.13% | 0.84 |
| Cleaner tailings solution | 2.10 l | 0.529 g/l | 3.35 |
| Recleaner tailings solids | 38.0 g | 4.29% | 4.92 |
| Recleaner tailings solution | 1.30 l | 0.291 g/l | 1.14 |
| Recleaner float solids | 76.0 g | 33.5% | 76.8 |
| Recleaner float solution | 0.575 l | 0.481 g/l | 0.83 |

*expressed as percentage of total nickel in the feed slurry

The primary precipitation followed by the three stages of flotation thus yielded a concentrate containing over 33% nickel and representing about 77% of the nickel to be recovered. The other constituents of the high grade concentrate were found to be as follows: 3.3% Co, 8% Fe, 0.04% Mn, 0.5% Ca, 0.5% Mg, 2.0% Al and 36% S. The amount of iron which reported in this concentrate corresponds to only about 0.5% of the total iron in the leach slurry feed.

The filtrate separated from the recleaner concentrate was combined with the tailings of the rougher and cleaner flotations to provide the feed to the scavenging operation. This operation involved a precipitation and a simple one-stage flotation and the precipitation differed from the primary precipitation only in the amount of calcium sulfide used. For the scavenging precipitation 4.64 moles of CaS were used per mole of ($Ni^{2+}+Co^{2+}$) present in the scavenger feed. The results of the scavenging operation are shown in Table 5.

TABLE 5

| Stream | Weight or Volume of Stream | Ni Analysis of Stream | Distribution* of Ni in Stream |
|---|---|---|---|
| Scavenger feed solids | 2286 g | 0.08% | 5.84 |
| Scavenger feed solution | 8.95 l | 0.418 g/l | 11.3 |
| Scavenger concentrate | 253.2 g | 1.25% | 9.85 |
| Scavenger tailings | 2231.5 g | 0.08% | 5.54 |
| Scavenger filtrate | 16.3 l | 0.035 g/l | 1.77 |

*expressed as percentage of total nickel in initial leach slurry

It will therefore be seen that adopting the above described procedure results in recycling a scavenger concentrate containing about 10% of the total nickel available in the leach slurry. Further optimization of the scavenger flotation, e.g., resort to a multistage flotation, could provide a higher nickel grade in the scavenger concentrate. Redissolution of precipitated nickel in the recycled slurries can be achieved by a number of techniques well known in the art.

The present invention has been specifically described with reference to preferred embodiments thereof. It will be appreciated that various additions or modifications may be made to the details of those embodiments without departing from the scope of the invention which is defined by the appended claims.

What we claim is:

1. A process for separating at least one non-ferrous metal selected from the group consisting of nickel and cobalt from a slurry which contains dissolved non-ferrous metal(s) and iron oxide solids, comprising adjusting the acidity of the slurry, if necessary, to ensure that the pH thereof does not exceed about 4; contacting the slurry with a sulfiding agent selected from the group consisting of calcium sulfide and barium sulfide, at a temperature of about 60°–80° C., in a plurality of series-connected reactors, the residence time in the first reactor of the series being shorter than about 15 minutes; controlling the overall residence time as well as the amount of sulfiding agent used to ensure precipitation of a large proportion of the non-ferrous metal as a sulfide; and thereafter subjecting the resulting slurry to flotation to recover a high grade concentrate containing a large proportion of the non-ferrous metal and a tailings slurry containing substantially all of the iron oxide solids.

2. A process in accordance with claim 1 wherein the precipitation of the non-ferrous metal sulfide is effected by continuously feeding the slurry to be treated and an aqueous slurry of the sulfiding agent into the series of reactors.

3. A process in accordance with claim 2 wherein the residence time in the first reactor of the series is less than about 3 minutes.

4. A process in accordance with claim 1 wherein the pH of the feed slurry is adjusted to ensure that a pH of about 4 is not exceeded during or at the end of the precipitation process.

5. A process in accordance with claim 4 wherein the pH of the feed slurry is adjusted to an initial value of between 2 and 3.

6. A process in accordance with claim 1 wherein the amount of the sulfiding agent, and the overall reaction time are so selected as to ensure that at least 50 mg/l of the non-ferrous metal remains in solution at the end of the reaction, whereby a high grade as well as a high recovery of the non-ferrous metal in the high grade concentrate are ensured.

7. A process in accordance with claim 6 wherein the amount of the non-ferrous metal which remains dissolved at the end of the reaction is between 100 and 300 mg/l.

8. A process in accordance with claim 6 wherein the tailings slurry is treated with further amounts of the sulfiding agent and heated and maintained at 60°–80° C. for a second reaction time sufficient to ensure that substantially all of any remaining amount of the non-ferrous metal is sulfided and wherein the slurry resulting from the second reaction is subjected to flotation to recover a second concentrate containing the sulfide of the non-ferrous metal.

9. A process in accordance with claim 8 wherein the second concentrate is recycled by redissolving the precipitated nickel in fresh feed slurry.

* * * * *